US005593228A

United States Patent [19]

Tannenbaum

[11] Patent Number: 5,593,228

[45] Date of Patent: Jan. 14, 1997

[54] ROTARY SHAKER WITH FLEXIBLE STRAP SUSPENSION

[75] Inventor: Myron Tannenbaum, Cranbury, N.J.

[73] Assignee: New Brunswick Scientific Co., Inc., Edison, N.J.

[21] Appl. No.: 642,341

[22] Filed: May 3, 1996

[51] Int. Cl.[6] ..... B01F 11/00

[52] U.S. Cl. ..... 366/209; 366/208

[58] Field of Search ..... 366/110, 111, 366/112, 114, 128, 208, 209, 210, 211, 213, 214, 215, 216, 219

[56] References Cited

U.S. PATENT DOCUMENTS

| | | | |
|---|---|---|---|
| 639,404 | 12/1899 | Kolls . | |
| 3,539,156 | 11/1970 | Zipperer et al. . | |
| 4,125,335 | 11/1978 | Blume et al. | 366/209 |
| 4,147,516 | 4/1979 | deBruyne . | |
| 4,183,677 | 1/1980 | deBruyne . | |
| 4,422,768 | 12/1983 | Solomon . | |
| 4,619,532 | 10/1986 | Schmidt, III | 366/110 |
| 4,702,610 | 10/1987 | Reynolds, Jr. | 366/208 X |
| 4,750,845 | 6/1988 | Nabetani | 366/208 |
| 5,052,812 | 10/1991 | Tannenbaum . | |
| 5,060,151 | 10/1991 | Mikyska . | |
| 5,372,425 | 12/1994 | Tannenbaum et al. . | |
| 5,427,451 | 6/1995 | Schmidt . | |

*Primary Examiner*—Charles E. Cooley
*Attorney, Agent, or Firm*—Richard C. Woodbridge

[57] ABSTRACT

A rotary shaker employs two pairs of straps which lie in planes perpendicular to each other to constrain the orbital motion of the shaker. A motor and an eccentric drive are mounted on a base plate. The base plate also supports a first or lower pair of flexible straps located on opposite sides of the base plate. Four posts attach the ends of the lower pair of straps to the four corners of the base. A first center plate is located above the base and is attached by a first pair of tabs connecting the intermediate section of opposite sides of the first plate to the intermediate sections of said lower pair of flexible straps. A pair of apertures in the first plate permits the motor and the eccentric drive to pass through. A drive belt connects a pulley on the motor to a pulley on the eccentric drive on the side of the first plate opposite from said base. A second or upper plate is located above the first plate and is attached in the center thereof to a support plate mounted on the shaft of the eccentric drive. A second or upper pair of flexible straps is attached to the second plate by four posts located at the four corners of the second plate. The first pair of flexible straps lie in planes parallel to each other but perpendicular to the planes of the second pair of flexible straps. The second plate is attached by a second pair of tabs to the intermediate sections of the second, upper pair of flexible straps. A sample tray is attachable to the second plate. The first and second pair of flexible straps constrain the flasks carried by the tray to travel smoothly in a circular orbit. The flexible strap support posts permit the flexible straps to flex without stretching thereby substantially increasing the life of the shaker. The rotary shaker is relatively inexpensive to produce, minimizes the use of bearings, has a relatively long and noise free life, is relatively easy to assemble and exhibits minimal backlash.

10 Claims, 6 Drawing Sheets

ROTARY SHAKER WITH FLEXIBLE STRAP SUSPENSION

BACKGROUND OF THE INVENTION

1. Field of the Invention

The invention relates to a rotary shaker which includes two pairs of flexible straps, mounted at right angles with respect to each other, that constrain the motion of the shaker tray to a circular, controlled orbit which results in a smooth action with minimal power input.

2. Description of Related Art

The prior art literature describes a limited number of efforts to support a variety of different shaker mechanisms with flexible members. The following is believed to be a relevant sampling of that prior art.

U.S. Pat. No. 4,183,677 issued Jan. 15, 1980 and entitled "MECHANISM FOR EFFECTING ORBITAL MOTION OF A MEMBER" describes a shaker device which includes four resilient flexible springs which collectively form the four corners of a square. The flexible springs provide support and control for the orbital motion of the shaker. The mechanism, however, appears to be moderately complicated. Note also, U.S. Pat. No. 4,147,516, issued to Norman A. DeBruyne, the inventor named in U.S. Pat. No. 4,183,677. That patent describes another oscillating mechanism including the use of flexible, vertical members for supporting a platform.

U.S. Pat. No. 5,427,451 entitled "MIXER WITH AN OSCILLATING DRIVE" describes a laboratory device which includes a set of leaf springs which support and control the oscillatory motion of the device. The structure of that device, however, appears to be adapted primarily for use with ultrasonic drivers and, accordingly, does not appear to be appropriate for mixers of a different speed range.

U.S. Pat. No. 5,060,150 issued on Oct. 22, 1991 and entitled "SPEED CONTROL FOR ORBITAL SHAKER WITH REVERSING MODE" discloses another laboratory shaker which includes flexible, vertical elements for supporting an upper platform by a lower platform.

U.S. Pat. No. 3,539,156 issued on Nov. 10, 1970 and entitled "VIBRATOR 0R SHAKER" describes another laboratory device in which a pedestal includes a support means that is resiliently suspended by the pedestal.

U.S. Pat. No. 639,404 entitled "MACHINE FOR SHAKING BABCOCK MILK TEST BOTTLES" and issued on Dec. 19, 1899 describes an industrial mixer including two supports which act like springs which permit the upper section of the mixer to oscillate back and forth with respect to the rest of the support mechanism.

U.S. Pat. No. 5,060,151 issued on Oct. 22, 1991 and entitled "SPEED CONTROL FOR ORBITAL SHAKER WITH REVERSING MODE" discloses a unique suspension mechanism including a pair of flexible links which permit a support tray to oscillate between two different positions.

U.S. Pat. No. 4,422,768 issued on Dec. 27, 1983, entitled "PAINT CAN SHAKER" describes another shaker mechanism including a plurality of flexible support springs.

U.S. Pat. No. 5,052,812 issued on Oct. 1, 1991 and entitled "BATH SHAKER" and U.S. Pat. No. 5,372,425 issued on Dec. 13, 1994 and entitled "CUSHIONED RESTRAINING DEVICE" are examples of conventional shakers of recent design but having substantially different suspension mechanisms. Both U.S. Pat. Nos. 5,052,812 and 5,372,425 are assigned to New Brunswick Scientific Company, Inc., the assignee of the present invention.

Lastly, U.S. Pat. Nos. 5,015,366; 4,176,750 and RE 31,660 are cited as being of general interest only but otherwise do not appear to be relevant to the present invention.

None of the foregoing prior art appears to teach or suggest a simple, low-cost, effective rotary shaker apparatus employing resilient members in a structure such as that described in this disclosure and, moreover, none of the prior art devices appear to describe or suggest the unique manner in which the flexible resilient members are attached to the rigid portion of the supporting frame.

SUMMARY OF THE INVENTION

Briefly described, the invention comprises a rotary shaker that employs two pairs of resilient, flexible straps which lie in planes perpendicular to each other in order to constrain the motion of the shaker tray to a smooth orbital path. A base plate supports the motor and an eccentric drive which is driven by the motor. The base plate also supports a lower, first pair of flexible straps located on opposite sides of the base plate. Four posts attach the ends of the pair of lower straps to the four corners of the base plate. A center plate is located above the base plate. It is attached by a pair of tabs connecting the intermediate section of opposite sides of the center plate to the intermediate sections of the lower, first pair of flexible straps attached to the base plate. A first aperture located in the center of the center plate permits the eccentric drive to pass through and a second aperture located near the corner of the center plate permits the motor to pass through. A drive belt connects a motor pulley to an eccentric driven pulley located between the center plate and the upper plate. The pulley incorporates a counterweight which is diametrically opposite to the eccentric pin. An upper plate is located above the center plate and is attached in the center thereof to the eccentric drive mechanism. A second, upper pair of flexible straps is attached to the center plate by four upper support posts located at the four corners of the center plate. The pair of upper, or second, flexible straps are supported by flexible strap support posts which flex without stretching. The lower, first pair of flexible straps are located in planes parallel to each other but perpendicular to the planes of the upper, second flexible straps. The upper plate is attached by another pair of tabs to the intermediate sections of the upper, second pair of flexible straps. The upper plate is supported by the eccentric drive and the center plate is substantially supported by the upper plate. A flask support tray is attachable to the upper plate. The first and second pairs of flexible straps restrain the motion of the upper plate, and, therefore, the tray, to the X-Y plane. The flasks, held by the tray, therefore oscillate in smooth, circular orbits. The improved rotary shaker apparatus is relatively inexpensive to produce, minimizes the use of bearings, has a relatively long and noise-free life, exhibits no backlash and is easy to assemble. The device also exhibits minimal drag and can be started and operated with minimal power while generating minimal heat. These and other features of the invention will be more fully understood by reference to the following drawings.

DETAILED DESCRIPTION OF THE PREFERRED EMBODIMENT

During the course of this description, like numbers will be used to identify like elements, according to the different views that illustrate the invention.

Figure 1:
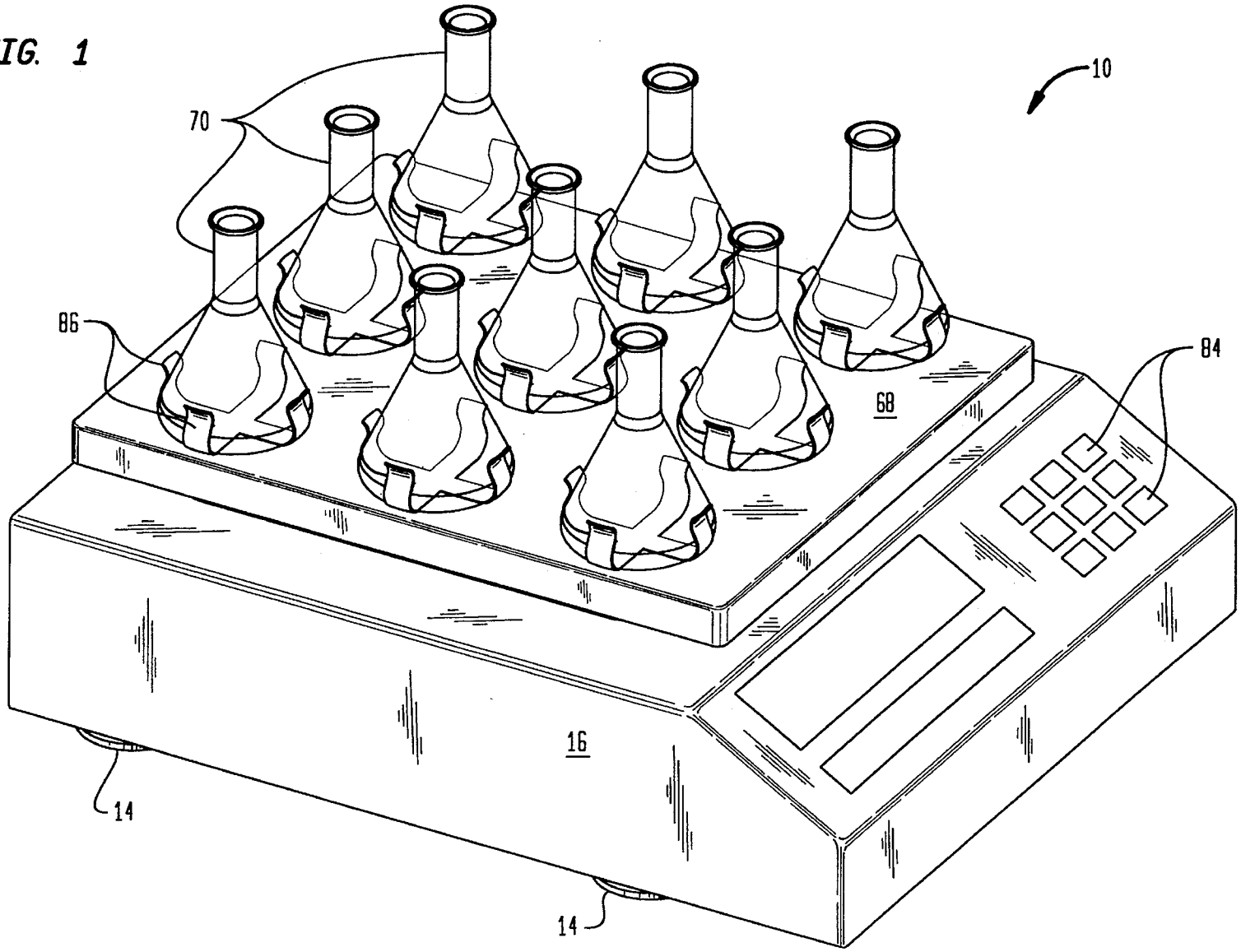
FIG. 1 is a side perspective view of the rotary shaker apparatus according to the preferred embodiment of the invention.
Figure 2:
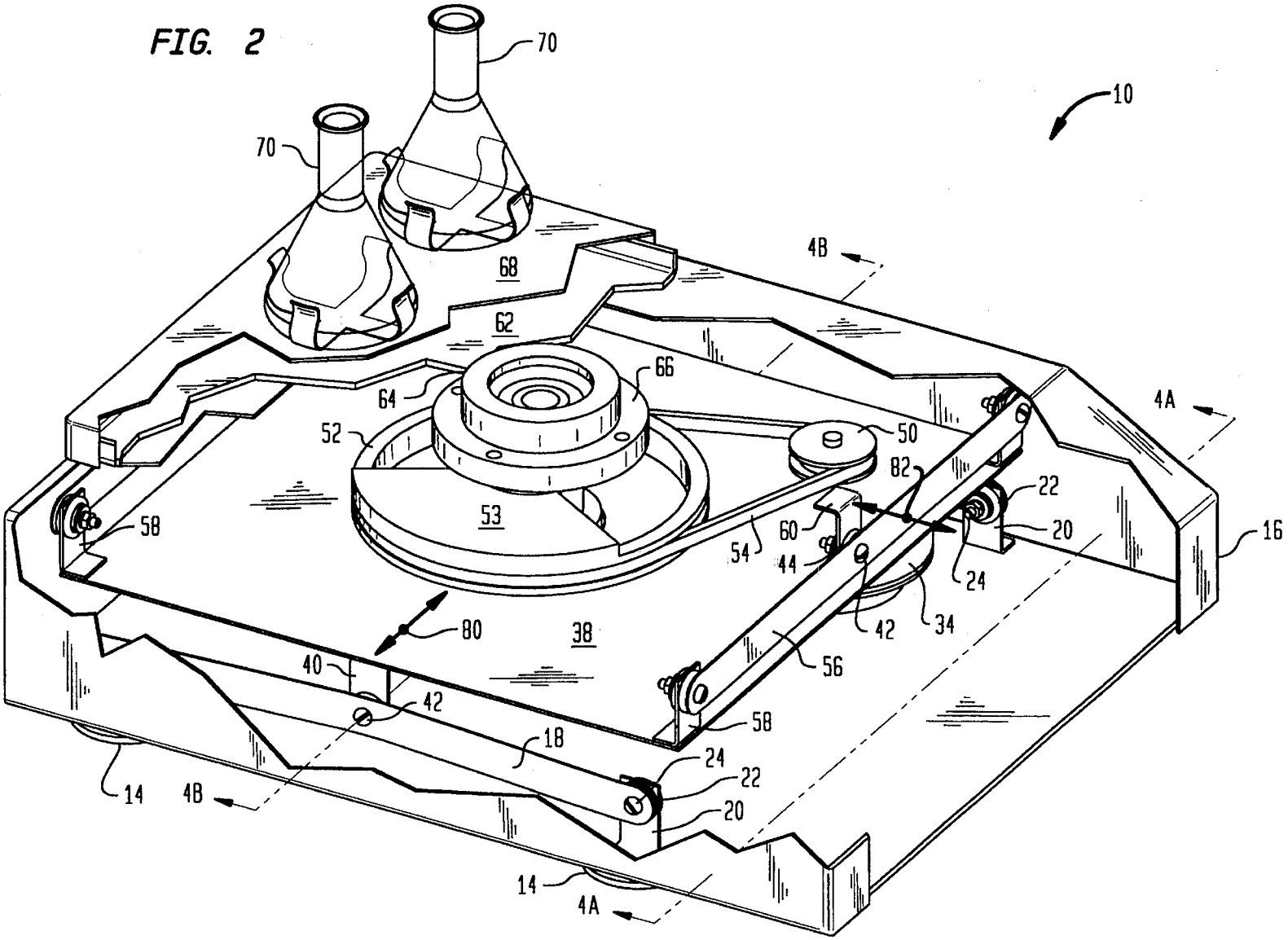
FIG. 2 is a partial cutaway perspective view of the rotary shaker illustrated in FIG. 1.
Figure 3A:
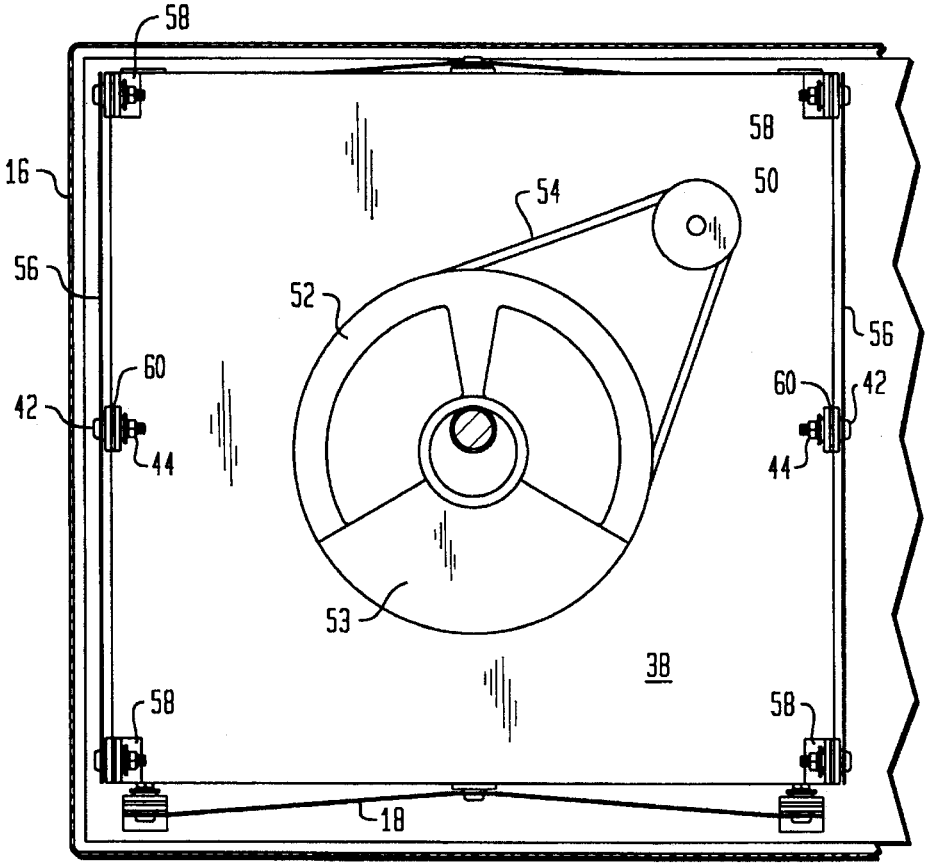
FIG. 3A is a cross-sectional plan view of the rotary shaker apparatus illustrating the center plate from perspective 3A—3A and showing the cast driven eccentric pulley as including a counterweight.
Figure 3B:
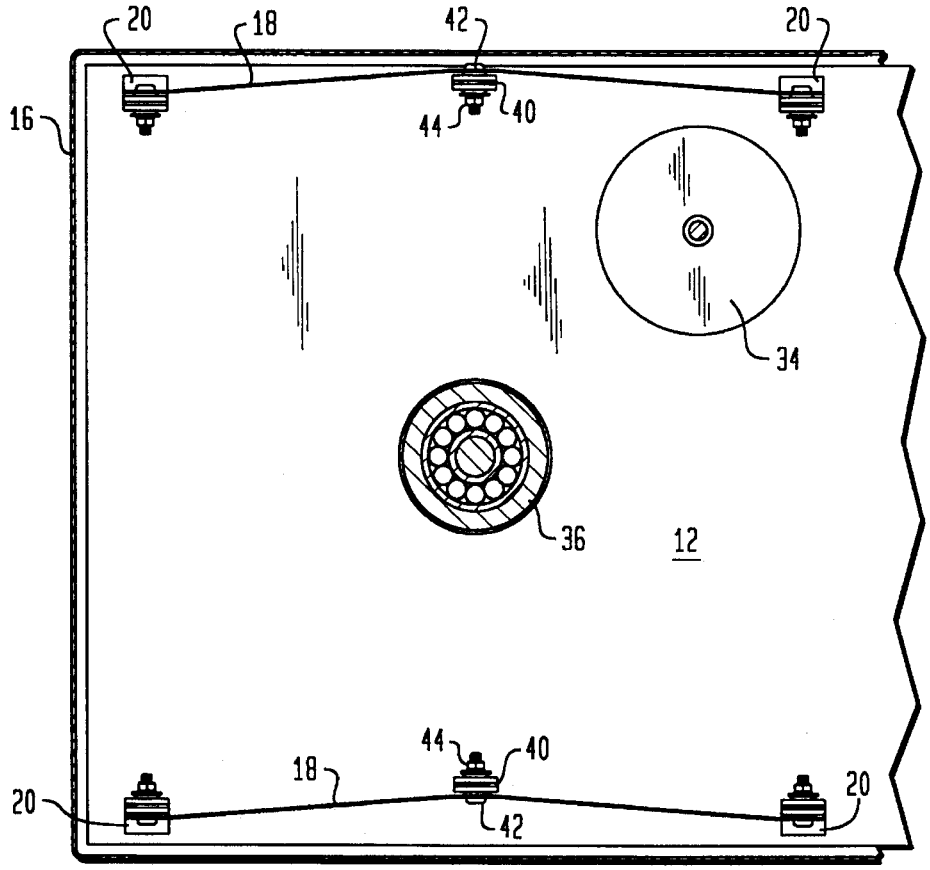
FIG. 3B is a cross-sectional plan view of the rotary shaker apparatus illustrating the lower, base plate from perspective 3B—3B.
Figure 4A:
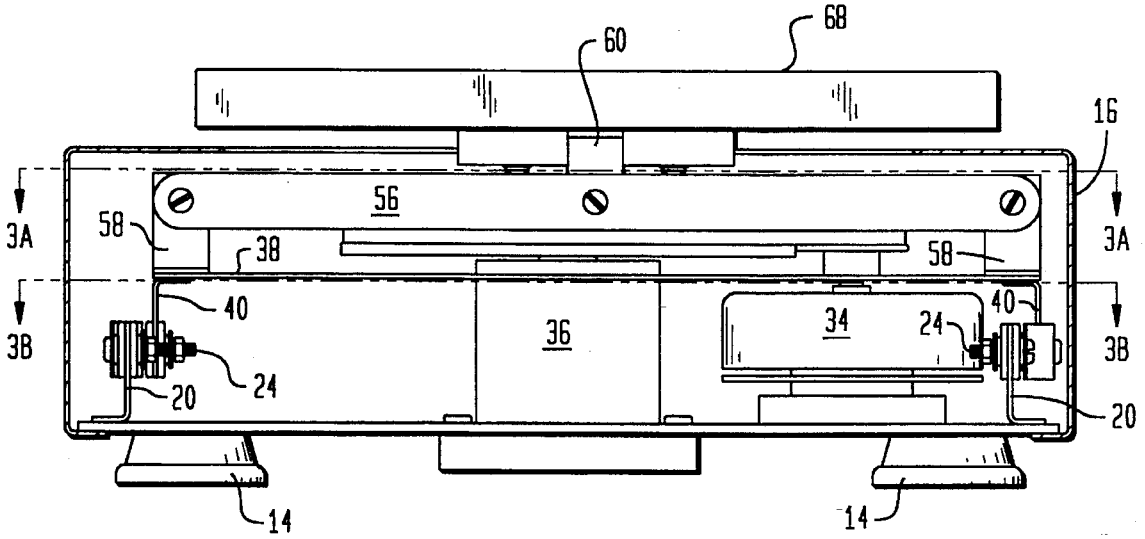
FIG. 4A is a vertical cross-sectional view of the rotary shaker apparatus as seen from perspective 4A—4A.
Figure 4B:
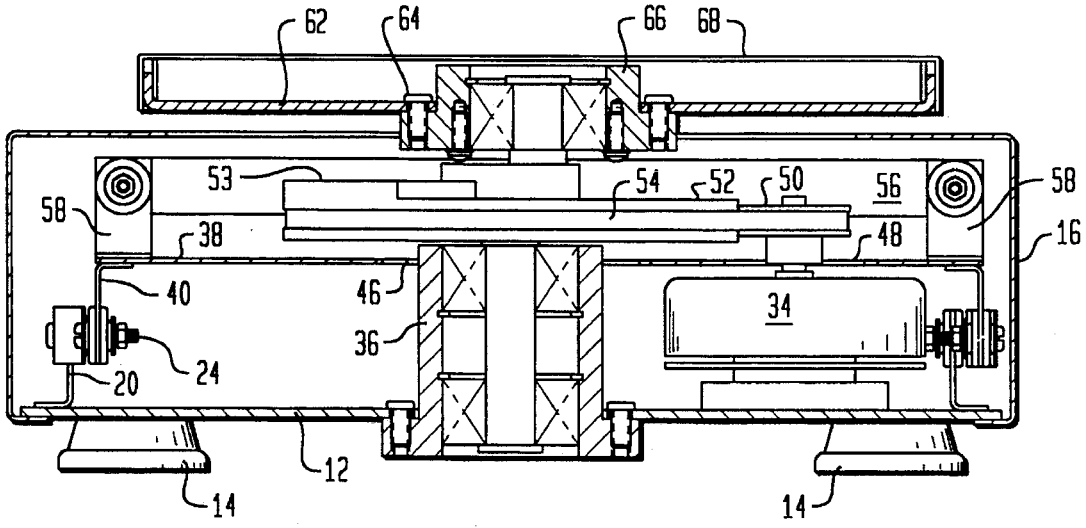
FIG. 4B is a vertical cross-sectional view of the rotary shaker apparatus as seen from perspective 4B—4B.

FIG. 1 is a side perspective view of the rotary shaker apparatus according to the preferred embodiment of the invention 10. FIG. 2 is a partial cutaway view of the preferred embodiment 10 illustrated in FIG. 1 showing how the internal elements cooperate with each other. FIGS. 3A–4B are various related cross-sectional views of the preferred embodiment 10 shown in FIGS. 1 and 2. The invention 10 includes a base plate 12 supported by four, conventional, rubberized, adjustable feet 14. A chassis or skin 16 protects the internal parts. A pair of first or lower flexible straps 18, located on opposite sides of the base 12, are connected to the base 12 by four strap support posts 20. Each of the four, lower strap support posts 20 are located respectively in each of the four corners of the base plate 12 and serve to connect the opposite ends of the two lower, flexible straps 18 to the base 12. The details of the lower strap support posts 20 and the associated mounting structures are illustrated in FIGS. 6A and 6B and described in more detail below.

Figure 6A:
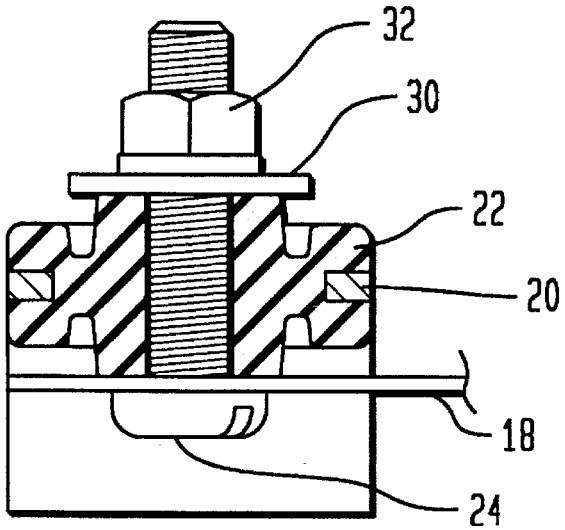
FIG. 6A illustrates one of the strap support posts.
Figure 6B:
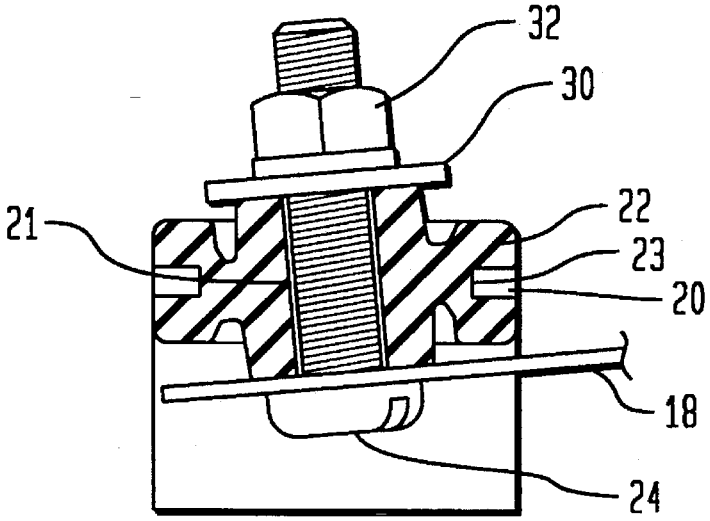
FIG. 6B illustrates the manner in which a strap support post, such as illustrated in FIG. 6A, flexes in response to the movement of one of the straps.

FIG. 6A shows one end of the flexible strap 18 connected to a strap support post 20 by a threaded bolt 24 and associated hardware 22, 30 and 32. Bolt 24 passes through a flexible grommet 22. Grommet 22 includes an aperture 21 therein and, in turn, sits in an aperture 23 in the vertical portion of the strap support post 20. Bolt or screw 24 passes through a hole in flexible strap 18 and a hole 21 in grommet 22 and emerges on the other side. A washer 30 and a nut 32 keep the flexible strap 18 securely locked on bolt 24. As shown in FIG. 6B, when the flexible strap 18 moves, it causes the bolt 24 to rotate thereby flexing grommet 22. This permits the center portion of each of the straps 18 to flex inward and outward easily with an absolute minimum of wear. A standard, conventional grommet 22 may be employed. Alternatively, other resilient structures having a similar shape and resiliency could also be used. This structure permits the rotary shaker apparatus to be used for thousands of hours without significant, discernible mechanical wear on the flexible straps or the support mechanism. Upper strap support posts 58 are attached to a second or upper pair of flexible straps 56 in a manner substantially identical to the manner described in FIGS. 6A and 6B, as will be discussed later in this disclosure.

In addition to the four lower strap support posts 20, the base 12 also supports a motor 34 and an eccentric drive 36. Motor 34 and eccentric drive 36 pass respectively through apertures 48 and 46 in center plate 38. Aperture 46 is located approximately in the center of center plate 38 whereas aperture 48, which permits motor 34 to pass therethrough, is located closer to one of the corners of the center plate 38. A motor pulley 50 is mounted on top of the drive shaft of motor 34 and accepts a belt drive 54 which connects it to a cast driven pulley 52 located on the driven shaft of eccentric drive 36. Cast driven pulley 52 includes a built-in counterweight 53 which is diametrically opposite the eccentric pin.

Center plate 38 is connected by a pair of tabs 40 on opposite sides thereof to the center portions, respectively, of the pair of lower flexible straps 18. A threaded bolt 42 passes through center portion of each of the straps 18 and through an aperture in the lower set of tabs 40 and is secured on the opposite side thereof by a conventional threaded nut 44. Therefore, straps 18 restrict the motion of the central plate to the direction illustrated by arrow 80.

Center plate 38 also supports four upper strap support posts 58, having a structure substantially identical to lower strap support posts 20 illustrated in FIGS. 6A and 6B, as previously described. The four upper strap support posts 58 are located respectively in the four corners of the center plate 38 and are attached to each of the opposite ends of the upper pair of flexible straps 56. Flexible straps 56 are, therefore, located on opposite sides of plate 38 and are parallel to each other. Similarly, lower flexible straps 18 are located on opposite sides of the base plate 12 and are parallel to each other, however, they are perpendicular to the plane and direction of the upper flexible straps 56 as is evident in FIGS. 2, 3A and 3B. Eccentric drive 36 is attached to an upper plate support 66 on its driven shaft which passes through an aperture 64 in upper plate 62. A pair of tabs 60, located on opposite sides of upper plate 62, connect the upper plate 62 to the center portion of the pair of upper flexible straps 56. A bolt 42 and a nut 44 attach the upper tabs 60 to the straps 56 in the same manner that the bolt 42 and nut 44 attach to the lower tabs 40 to the central portion of the lower flexible straps 18.

Upper flexible straps 56 constrain the upper plate 62 to reciprocate in a direction indicated by arrow 82. Similarly, lower flexible straps 18 constrain the center plate 38 to reciprocate in a direction indicated by arrow 80 which is perpendicular to the direction indicated by arrow 82. Center plate 38 is effectively suspended from the upper plate 62 by tabs 60, flexible straps 56 and upper strap support posts 58. Because the upper plate 62 is constrained to move in an orthogonal direction 82 which, in turn, is constrained to move in a perpendicular orthogonal direction 80, the flask support tray 68 cannot twist as it is driven by the eccentric 36 under the influence of motor 34. This desirable effect may be better by referring to FIGS. 5A and 5B.

Figure 5B:
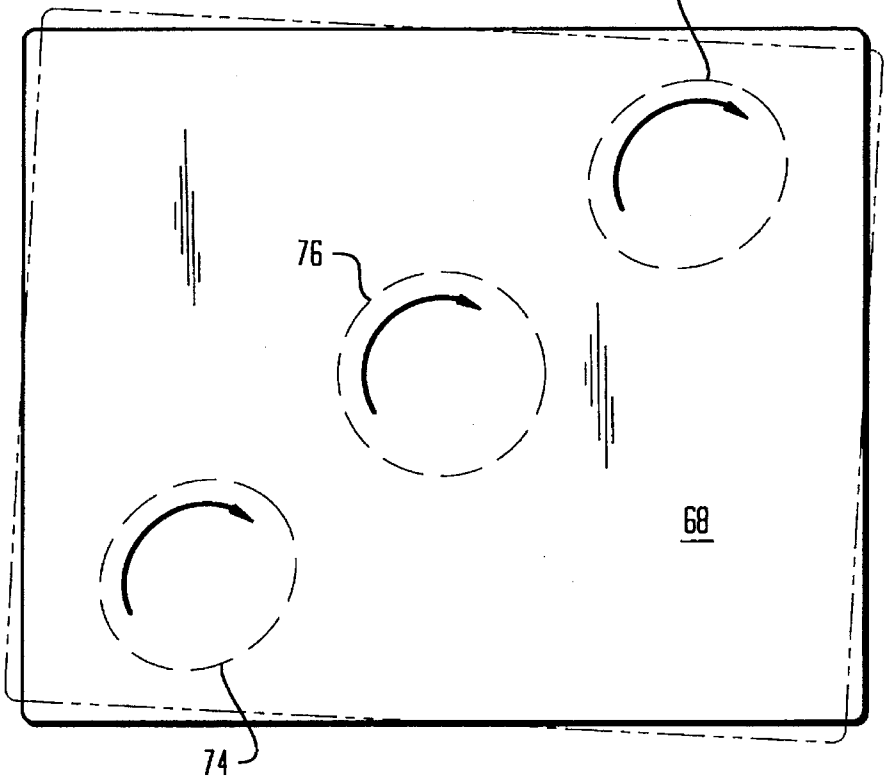
FIG. 5B illustrates the distortion introduced into the orbital paths of the outermost flasks on the tray if the motion of the eccentric drive is not constrained and shows phantom lines to indicate the loss of parallelism.
Figure 5A:
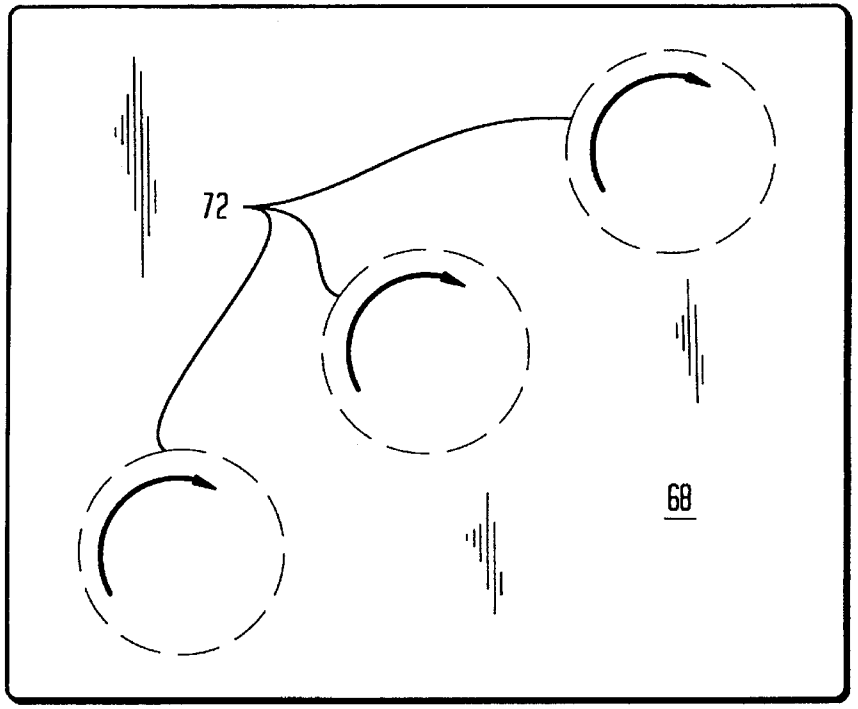
FIG. 5A illustrates the circular paths described by flasks on the tray under the correcting influence of the two pairs of flexible straps.

FIG. 5A illustrates the orbital paths 72 described by three laboratory flasks 70 driven by eccentric drive 36 and motor 34. Flasks 70 are held on tray 68 by conventional flask clamps 86 as shown in FIG. 1. Because the upper plate 66 and the flask support tray 68 are constrained to move only in orthogonal directions 80 and 82, it is substantially impossible for the tray 68 and flasks 70 to twist or turn under the influence of eccentric drive 36. Therefore, the paths 72 described by the flasks 70 are circular, smooth, regular and predictable.

FIG. 5B illustrates the orbital paths described by the flasks 70 without the beneficial effects of two pairs of flexible straps 18 and 56. The central flask describes a circular orbit 76 whereas the two outermost flasks describe an elliptical orbit 74. This, of course, results in nonuniform mixing of materials and can have a major negative impact on the ultimate value of the laboratory test results. The distorted orbits 74 of the outermost flasks are attributable to the twisting and turning motions that are introduced into the upper plate 62 if there is no constraint in the X-Y directions. Accordingly, the primary path and purpose of straps 18 and 56 is to prevent the upper plate 62 and flask support tray 68 from turning on their own axis, i.e., precessing.

Motor 34 and eccentric drive 36 are conventional, commercially available devices. Motor speed controls 84, and the like, such as made by New Brunswick Scientific Company, Inc., and also available from other suppliers, can be used to control the speed and intensity of the shaker by controlling the electrical power to the drive motor 34. The speed control 84 and the electrical power supply, as well as the drive motor 34 and eccentric drive 36, are conventional items and are not considered to be part of the basic inventive concept by themselves.

The invention, as described, has several advantages over prior art rotary shakers. First, it has a very long life, in large part, due to the fact that straps 18 and 56 can comfortably flex with an absolute minimum of wear. Bearings are required only in the center drive. A shaker of this design can operate for several thousand hours without repair or special maintenance. Second, the shaker is highly reliable because there are a minimal number of wear related moving parts. Third, the device is easily balanced because of its smooth operation and which results in a predictable circular orbit. Consequently, there is no backlash. Fourth, the apparatus is relatively noise free and the smooth drive allows for minimal torque to start and operate the unit. Fifth, the shaker apparatus is relatively inexpensive to manufacture thereby making it more affordable to laboratories and students on a limited budget. Sixth, the apparatus generates very little heat.

While the invention has been described with reference to the preferred embodiment thereof, it will be appreciated by those of ordinary skill in the art that various modifications can be made to the structure and function of the invention without departing from the spirit and the scope of the invention as a whole.

I claim:

1. A rotary shaker apparatus comprising:

a base;

a motor attached to said base;

an eccentric drive attached to said base;

drive means connecting said motor to said eccentric drive;

first flexible strap means attached to said base;

first plate means attached to said first flexible strap means so that said first plate means is constrained to oscillate in a first direction relative to said base;

a second flexible strap means attached to said first plate means; and, a second plate means attached to said eccentric drive and also attached to said second flexible strap means so that said second plate means can oscillate in a second direction substantially perpendicular to said first direction; and, tray means for supporting mixing containers attachable to said second plate means, wherein said tray means and said second plate means oscillate in an orbit constrained by said first and second flexible strap means.

2. The apparatus of claim 1 wherein said first and second flexible strap means comprise flexible straps each having a first and a second end and an intermediate section.

3. The apparatus of claim 2 further comprising:

flexible strap mounting means for attaching said first and second ends of said flexible straps to said base and said first plate means respectively, wherein said flexible strap mounting means flexes with said flexible straps so that said flexible straps do not significantly stretch during flexing.

4. The apparatus of claim 3 wherein said first flexible strap means comprises a first pair of said flexible straps each attached to opposite sides of said base by a pair of said flexible strap mounting means respectively.

5. The apparatus of claim 4 wherein said second flexible strap means comprises a second pair of said flexible straps each attached to opposite sides of said first plate means by a pair of said flexible strap mounting means respectively, wherein said first pair of flexible straps each lie in a plane parallel to each other and said second pair of flexible straps also each lie in a plane parallel to each other but in planes substantially perpendicular to the planes of said first flexible straps.

6. The apparatus of claim 5 further comprising:

a first pair of tab means for attaching said first plate means to the intermediate section of said first pair of flexible straps respectively.

7. The apparatus of claim 6 further comprising:

a second pair of tab means for attaching said second plate means to the intermediate section of said second pair of flexible straps respectively.

8. The apparatus of claim 7 wherein said flexible strap mounting means comprises:

a post for attachment to said base or said first plate means, said post having an aperture therein;

a resilient means located in said aperture in said post; and, an attachment means passing through said resilient means and attachable to said first or second end of each of said flexible straps.

9. The apparatus of claim 8 wherein said resilient means comprises a resilient grommet-like structure.

10. The apparatus of claim 9 wherein said first plate means includes a first aperture therein which permits a portion of said motor to pass therethrough and wherein said first plate means also includes a second aperture substantially in the center thereof which permits a portion of said eccentric drive to pass therethrough and wherein said drive means comprises a belt connecting said portion of such eccentric drive that passes through said second aperture to the portion of said motor that passes through the first aperture in said first plate means.

* * * * *